US005253780A

United States Patent [19]

Adado

[11] Patent Number: 5,253,780

[45] Date of Patent: Oct. 19, 1993

[54] THERMAL DRINKING CUP

[76] Inventor: John G. Adado, 3308 S. Creek Dr., Suite 202, Grand Rapids, Mich. 49512

[21] Appl. No.: 902,945

[22] Filed: Jun. 23, 1992

[51] Int. Cl.[5] ..... B65D 11/00

[52] U.S. Cl. ..... 220/711; 220/716; 220/719; 220/737

[58] Field of Search ..... 220/737, 738, 739, 741, 220/703, 711, 716, 719

[56] References Cited

U.S. PATENT DOCUMENTS

| | | | |
|---|---|---|---|
| D. 289,955 | 5/1987 | Buist . | |
| 2,437,784 | 3/1948 | Laskin . | |
| 3,915,355 | 10/1975 | Young . | |
| 4,099,642 | 7/1978 | Nergard . | |
| 4,133,446 | 1/1979 | Albert . | |
| 4,136,799 | 1/1979 | Albert . | |
| 4,190,173 | 2/1980 | Mason et al. . | |
| 4,212,408 | 7/1980 | Valenzona . | |
| 4,394,928 | 7/1983 | Philip . | |
| 4,548,349 | 10/1985 | Tunberg | 220/738 |
| 4,671,424 | 6/1987 | Byrns | 220/739 |
| 4,813,558 | 3/1989 | Fujiyoshi | 220/739 |
| 4,974,741 | 12/1990 | Gustafson et al. | 220/739 |
| 4,986,437 | 1/1991 | Farmer . | |

*Primary Examiner*—Joseph Man-Fu Moy
*Attorney, Agent, or Firm*—Ian C. McLeod

[57] ABSTRACT

A drinking receptacle (10) comprised of a beverage container (12) having a removeable cover (16) and an insulating sheath (14) mounted on the sidewall (20) of the container, is described. The cover serves as a closure for the open end of the container and is comprised of a canted top wall (58) having a vent opening (62) and a drinking slot (64). The drinking slot enables virtually the entire beverage contents of the container to be drank. The sheath is preferably made of an extruded sheet of closed cell polyolefin elastomeric material having an outer laminated coating. This enables a person to comfortably hold the drinking receptacle in their hand even when the temperature of the beverage held in the container is at or near the boiling point.

31 Claims, 4 Drawing Sheets

THERMAL DRINKING CUP

Background of the Invention (1) Field of the Invention

The present invention relates to a drinking receptacle for holding and dispensing beverages. In particular, the present invention relates to a drinking receptacle comprising an open container having an insulating outer sheath with a removeable cover closing the container. The insulating sheath is made of a thermally resistive material and enables a person to comfortably handle the container even when the container holds a beverage having a temperature at or near the boiling point. The sheath helps prevent the heat of the beverage from being conducted away from the container. That way, the beverage does not cool rapidly and the container can be comfortably handled. The insulating characteristics of the sheath also work well when the beverage is cold. In this case, the insulating sheath helps maintain the cold temperature of the beverage by preventing heat from conducting to the beverage, through the sheath and the container.

The container is comprised of a frusto-conically shaped outside sidewall that increases in diameter from a bottom wall. The sidewall meets with an outwardly extending ledge which then forms into an open flange. The flange provides for snappingly receiving the cover, which closes the container. The cover has a tilted or canted top wall that is provided with a vent opening and a drinking slot. The drinking slot is positioned on the top wall so that virtually the entire beverage contents of the container can be drunk. The insulating sheath material, which is made from a sheet of closed cell polyolefin elastomer, is mounted on the outside sidewall of the container, abutting the container ledge. That way, the sheath and the open flange blend together to provide the drinking receptacle with a clean, aesthetic look. The drinking receptacle is also shaped to fit conventional cup holders currently provided in many automobiles. Preferably, the shape of the container is such that two of the containers can be mounted side-by-side in the automobile cup holder.

(2) Prior Art

A wide variety of drinking cups and containers are provided with spill-proof covers to close the beverage container. These covers use various devices that provide for on demand opening of the cover. This enables a person to drink the beverage when they are ready, while preventing spillage when the cup is not being used. Many of these containers are made from insulating materials that serve to partially resist thermal conductivity of the temperature of a hot or a cold beverage held in the container. These insulated containers provide an acceptable degree of thermal insulation when the beverage is warm, but somewhat less then near the boiling point. However, when the beverage is at or near the boiling point, the prior art drinking containers fail to adequately insulate the beverage. Instead, a sufficiently large amount of heat is conducted from the beverage and through the sidewall of the container so that it is impossible for a drinker to safely and comfortably hold the container.

A practical solution is to fill the container only part way full with the hot beverage. Then, the drinker can hold the container by the top, unfilled portion of the container. This is an awkward drinking position and can be unsafe should the person also be driving an automobile. If the person does not have a firm grasp on the container, the container can slip out of their hand and spill. This can be extremely unsafe and could result in burns to the skin.

Another solution is to build the beverage container having a double-walled construction. This type of drinking container is shown in U.S. Pat. Nos. 4,190,173 to Mason et al and 4,212,408 to Valenzona. However, if the liquid to be drunk is extremely hot, such as at or near the boiling point, this type of cup will eventually conduct most of the heat to the outer wall. The double-walled construction is typically made by mounting an inner container inside an overly large outer container. This provides the container with a bulky, bulbous appearance. Also, the seal between the inner and outer containers can release which partially destroys the thermal integrity of the container. Double walled drinking containers can also be formed from a counter-pressure molding technique where a molten plastic material is introduced into a mold. The mold is then pressured up which causes the plastic to be forced to the sides of the mold, leaving the interior void. This process is costly.

Vacuum bottles also provide acceptable insulated containers for holding hot and cold beverages. Vacuum bottles are generally constructed with separable cups and a removeable container plug. To drain the beverage from the container, the user must hold the container in one hand and separate the drinking cup with the other. The cup is put in a resting place and then both hands must be used to remove the plug. The plug is then placed in a resting place and with the cup in one hand, the container is tilted to pour the beverage from the container. Finally, the filled cup must be placed back in its resting place and the plug remounted on the container with both hands. The cup itself is usually not insulated but instead is provided with a handle to prevent the heat generated by the beverage from burning the drinker.

U.S. Pat. No. 3,915,355 to Young describes a drinking receptacle made of polystyrene or other similar plastic materials. U.S. Pat. No. 4,133,446 to Albert describes a drinking vessel made of an insulating material, but does not describe the material. U.S. Pat. No. 4,136,799 to Albert describes a drinking receptacle having an outer layer of lexan and an inner lining of styrene. These containers do not provide sufficient thermal insulation to prevent a hot beverage held in the container from burning a person's hand holding the container. Acceptable alternatives are to provide the container with a handle, only partially fill the container and hold the container by the unfilled part or to place the container in a holder while the beverage is being drunk.

Other prior art containers for holding and dispensing beverages that are only generally related to the present invention include U.S. Pat. Nos. 2,437,784 to Laskin; 4,099,642 to Neroard; 4,394,928 to Philip; 4,986,437 to Farmer and Des. 289,955 to Buist.

What is needed is a drinking receptacle comprising a container for holding hot and cold beverages and that is comprised of an insulating material, which greatly reduces the thermal conductivity of the container. The container also needs to be able to be held by one hand without the use of a handle or a holder device.

OBJECTS

It is therefore an object of the present invention to provide a drinking receptacle that is comprised of a thermally insulated material. Further it is an object of the present invention to provide a drinking receptacle that greatly restricts the thermal conductivity of the beverage held in the receptacle. Still further, it is an object of the present invention to provide a drinking receptacle made from a plastic material provided with an outer sheath comprised of a thermally resistive material that enables a person to comfortably hold the receptacle in their hand when a beverage having a temperature at or near the boiling point is filled into the receptacle. Finally, it is an object of the present invention to provide a drinking receptacle that is relatively inexpensive to manufacture, clean in appearance and comprised of a material that is thermally non-conductive. These and other objects will become increasingly apparent by reference to the following descriptions and to the drawings.

IN THE DRAWINGS

GENERAL DESCRIPTION

Figure 2:
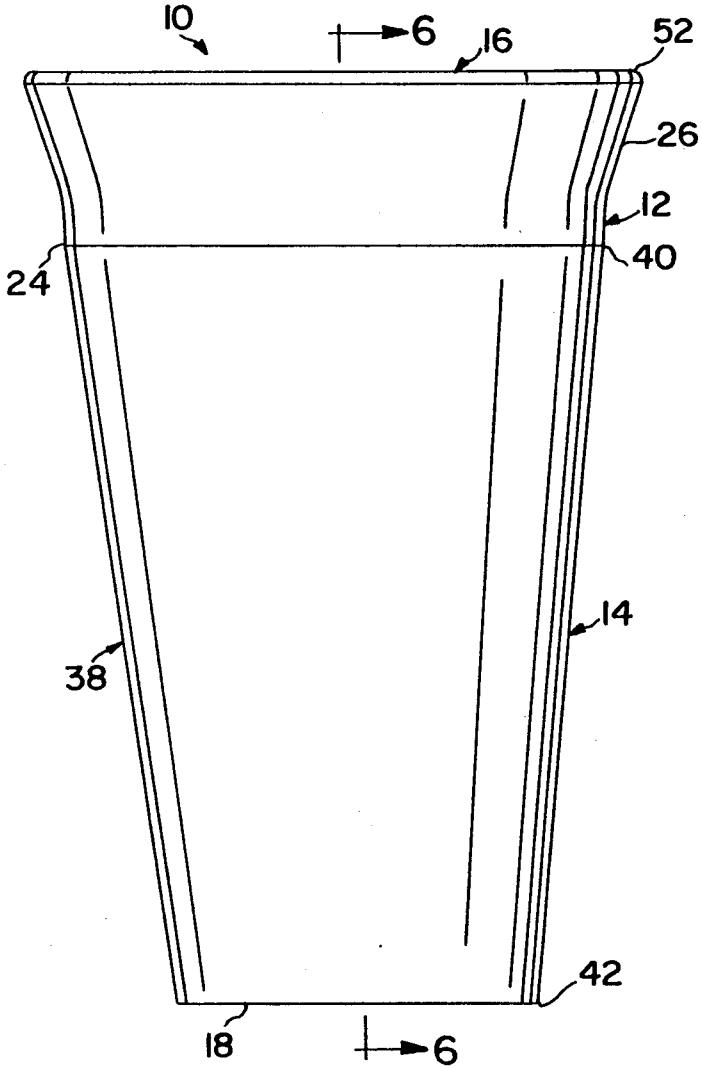
FIG. 2 is a rear side elevated view of the drinking receptacle 10 shown in FIG. 1.
Figure 1:
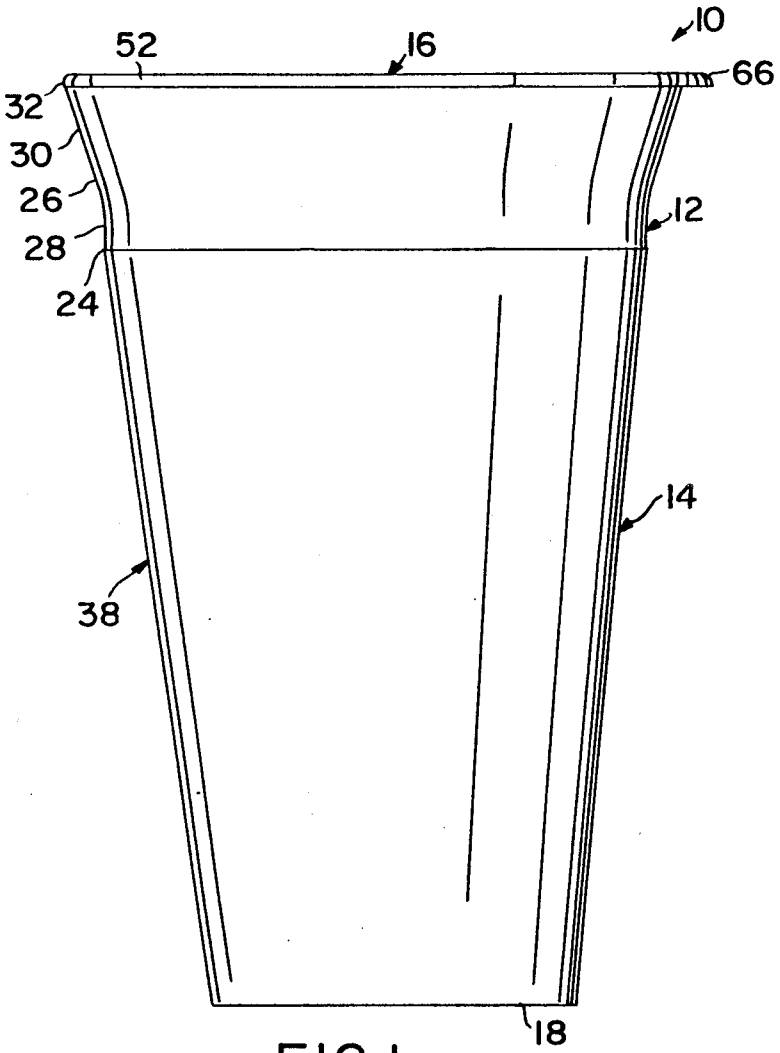
FIG. 1 is a left side elevated view of the drinking receptacle 10 of the present invention including the cover 16.

The present invention relates to a drinking receptacle for holding and dispensing a liquid beverage, which comprises, in combination: a container means comprising a surrounding sidewall extending along and around a longitudinal axis of the container means from a bottom wall to form an open end of the container means, wherein a first sealing member is provided at the open end; a cover means mountable on the container means and having a second sealing member that mates with the first sealing member to close the open end of the container means in a sealing engagement, wherein the cover means is comprised of a sidewall closed by a top wall having a drinking slot for removing the beverage from the drinking receptacle when the cover means is sealed on the container means; and an insulating sheath means laying on the sidewall of the container means and comprised of an elastomeric material, wherein the sheath means enables a person to hold the drinking receptacle in their hand when the beverage in the container means is at or near the boiling point without burning their hands.

SPECIFIC DESCRIPTION

FIGS. 1 to 7 show the improved drinking receptacle 10 of the present invention. The drinking receptacle 10 is generally comprised of a container 12 having an insulating sheath 14 and a removeable cover 16 for drinking beverages from the container 12. The insulating sheath 14 wraps around the outside of the container 12 and provides thermal insulation for beverages held in the container 12, such as hot coffee, hot tea, hot milk or the like or cold beverages.

Preferably, container 12 is made of a plastic material 20, such as molded and compressed melt polypropylene and is comprised of a bottom wall 18 having a generally circular shape in plan view with an upwardly extending hemispherical member 18A. An outside sidewall 20 having an inner surface 22 extends upwardly and outwardly from the bottom wall 18 to an annular, outwardly extending ledge 24, which meets with an open ended flange section 26. The flange section 26 extends from the outer edge of ledge 24 and is comprised of a lower, substantially cylindrical portion 28 that meets with and forms into an outwardly flaring lip 30. Lip 30 extends upwardly and outwardly with a taper that is somewhat greater than the taper of the container outside sidewall 20 before terminating in a planar rim 32. Rim 32 is perpendicular to the longitudinal axis of the container 12.

The inner surface 22 of the container sidewall 20 has an upwardly and outwardly extending taper that extends from the bottom wall 18 and meets with an inner flared surface 34. The taper of the inner surface 22 is similar to that of the outside sidewall 20 of the container 12. In a like manner, the inner flared surface 34 has a taper similar to that of the lip 30. However, the plane corresponding to where the inner surface 22 of the container 12 joins to form the inner flared surface 34 is spaced axially above the plane of ledge 24. The inner flared surface 34 is further provided with an annular sealing ridge 36 that extends inwardly from the inner flared surface 34, along a plane spaced below the rim 32.

The container 12 is completed by the insulating sheath 14, which is preferably cut from an extruded sheet of closed cell polyolefin foam material, such as polyethylene or polypropylene, laminated with an outer surface 38 of an extrusion coating. The sheath material can be purchased from Voltek, Division of Sekisui America Corp., Coldwater, Mich. under the trademark "VOLEXTEA TPE".

Figure 3:
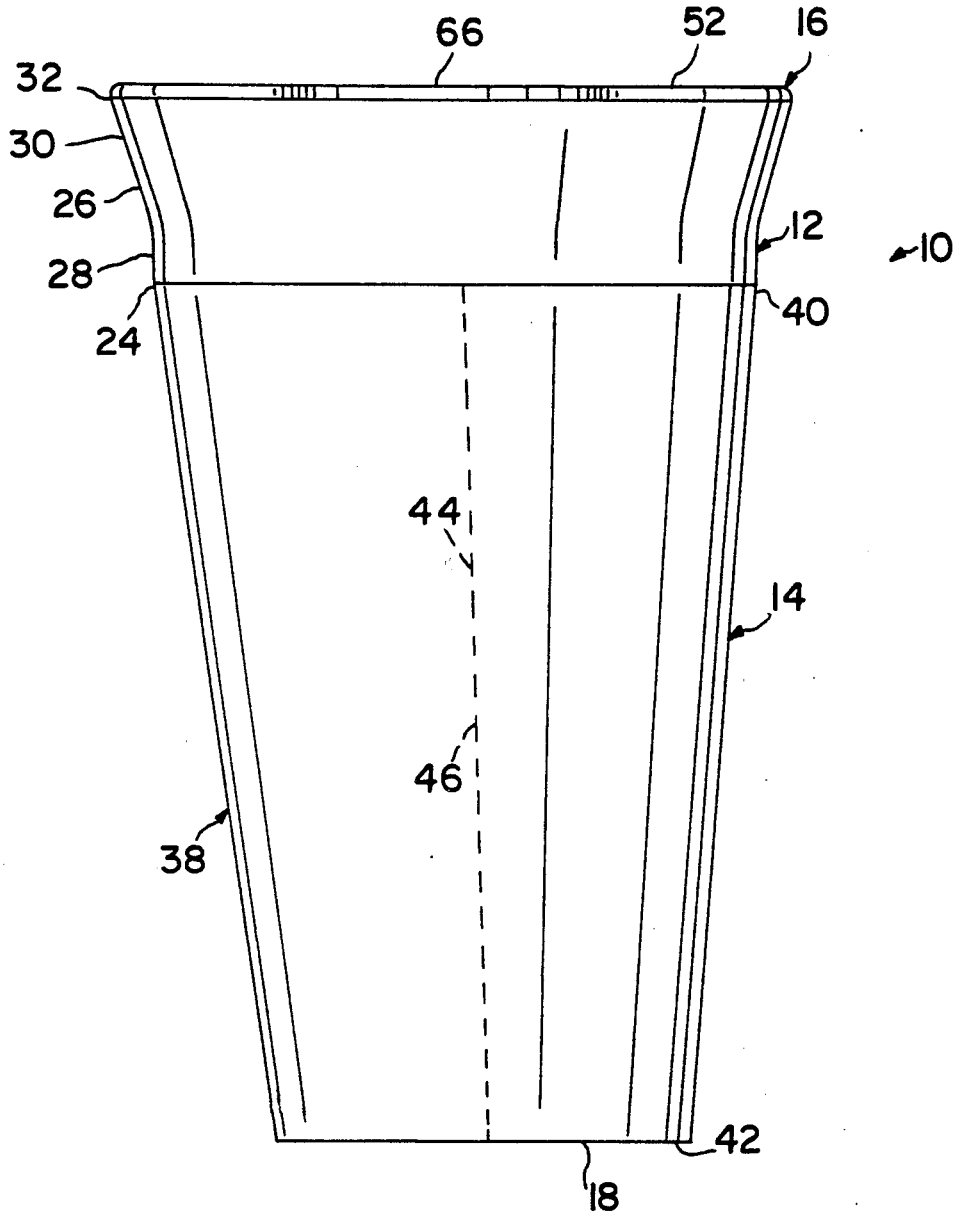
FIG. 3 is a front side elevated view of the drinking receptacle 10 shown in FIG. 1.
Figure 4:
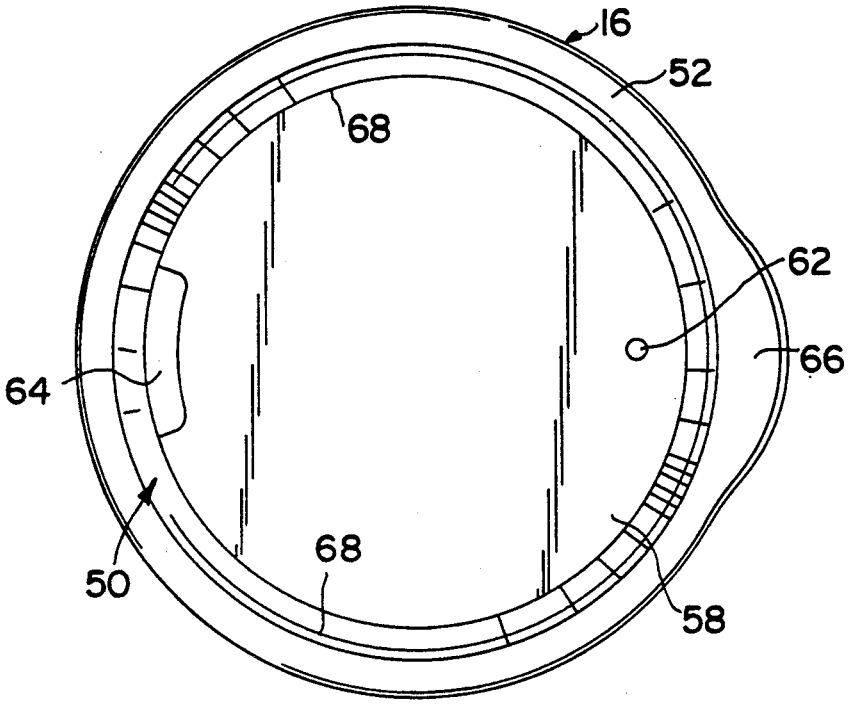
FIG. 4 is a top plan view of the drinking receptacle 10 shown in FIG. 1.
Figure 5:
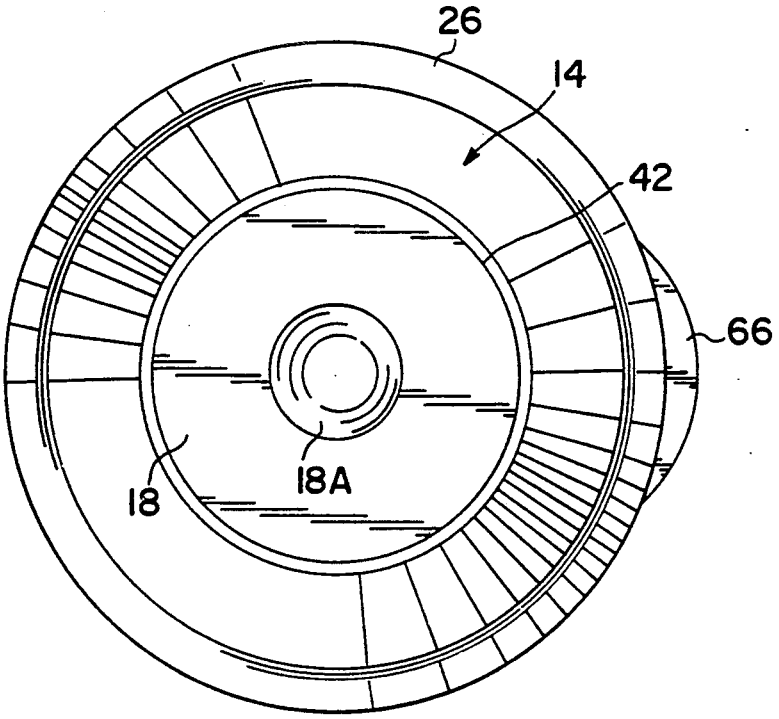
FIG. 5 is a bottom plan view of the drinking receptacle 10 shown in FIG. 1.

As shown in FIG. 3, the sheath 14 has an upper edge 40 and a lower edge 42 between opposed ends 44 and 46 with a thickness of the laminate that is similar to that of the depth of the ledge 24. The sheath is preferably precut and formed by folding the sheet material in half with the outer surface 38 of the two folded halves laying next to each other and the opposed ends 44 and 46 laying adjacent and even with each other. The ends 44 and 46 are then joined together by sewing, gluing, heat welding or some similar type of securing means to form the sheath 14 with the polyolefin material facing outwardly. The sheath 14 is then turned inside out so that the laminated material forming the outer surface 38 is exposed and the sheath 14 is slid over the outside sidewall 20 of the container 12. The sheath 14 is secured in place by gluing or similar securing means with the upper edge 40 abutting the ledge 24. In this position, the lower edge 42 of sheath 14 is substantially coplanar with the bottom wall 18 to give a clean appearance to the container 12. The sheath 14 can also be molded as a tapered cylinder.

The sheath 14 mounted on the container 12 provides an insulation means that greatly restricts the thermal conductivity of the heat transferred from the beverage held in the container 12 to the outer surface 38 of the sheath 14. When the temperature of the beverage held in the container 12 is 212° F. (10°–0° C.), the temperature of the outer surface 38 of the sheath 14 is at about 116° F. (46.7° C.). This is an acceptable sheath temperature which enables a person to hold the beverage cup 10 comfortably in their hand.

Figure 6:
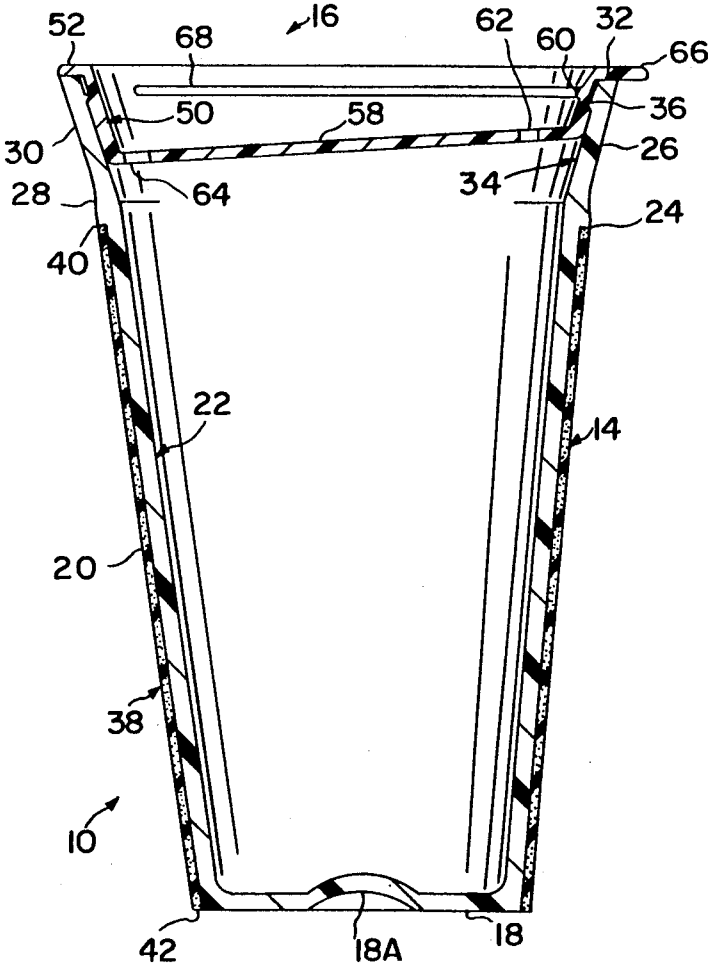
FIG. 6 is a cross-sectional view along line 6—6 of FIG. 2.
Figure 7:
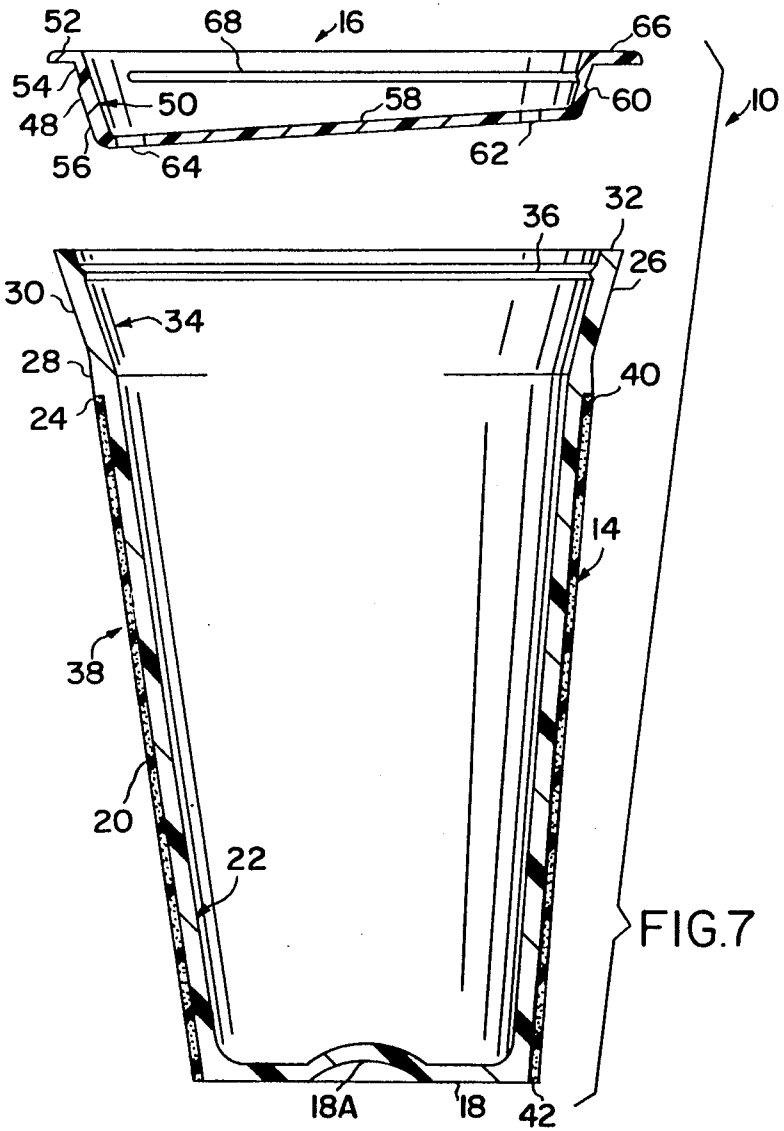
FIG. 7 is a cross-sectional view along a plane similar to that of FIG. 6 and showing the cover 16 removed from the container 12.

FIGS. 1 to 3 and 6 show the drinking receptacle 10 assembled with the removeable cover 16 sealing the open ended flange 26 of the container 12. As particularly shown in FIG. 7, cover 16 includes an outside sidewall 48 having an inner surface 50 extending to an annular web 52. The outside sidewall 48 is formed from a first frusto-conical portion 54 that depends from the inner edge of the annular web 52 to meet a second frusto-conical portion 56. A lower end of the second frusto-conical portion 56 meets with a top wall 58, which is canted or tilted relative to the vertical axis of the receptacle 10 when the cover 16 is assembled on the container 12. As shown, the second frusto-conical portion 56 is concentric with the first frusto-conical portion 54, but spaced radially outwardly from the vertical axis to form a cover ledge 60 where the first and second frusto-conical portions 54 and 56 meet. As shown in FIG. 6, when the cover 16 is mounted on the container 12, cover ledge 60 seats below ridge 36 to snappingly mount the cover 16 on the container 12.

The top wall 58 of cover 16 is provided with a vent opening 62 adjacent the high side of the top wall 58 and spaced from the inner surface 50 of the sidewall 48. The top wall 58 is further provided with an arcuately shaped drinking slot 64, diametrically opposite the vent opening 62. The drinking slot 64 meets flush with the inner surface 50 of the cover sidewall 48 on the low side of the top wall 58 so that virtually the entire volume of beverage held in the container 12 can be drained through the drinking slot 64.

The cover 16 is completed by a thumb tab 66 that extends radially outwardly from the annular web 52, adjacent the vent opening 62. Thumb tab 66 is shaped so that a person can remove the cover 16 from the container 12 by applying an upwardly directed force on the tab 66 with the pad of their thumb. This upward force on tab 66 causes the cover ledge 60 to release from the sealing ridge 36 provided on the inner flared surface 34 of the container 12. Also, the tab 66 is shaped not to interfere with a person's fingernails, especially those people having longer fingernails.

A substantially annular inner ring 68 (FIGS. 4 and 7) is provided on the inner surface 50 of the cover sidewall 48, except for adjacent the drinking slot 64. That way, ring 68 does not interfere with the beverage flowing through the slot 64 and into the person's mouth. The purpose of ring 68 is to help contain any beverage spattered or otherwise moved onto the top wall 58 of the cover 16 from splashing out of the cover 16. The spattered beverage can then drain back into the container 12, through the drinking slot 64 due to the downwardly slope or cant of the top wall 58 when the cover 16 is mounted on the container 12.

It is intended that the foregoing description be only illustrative of the present invention and that the invention be limited only by the hereinafter appended claims.

I claim:

1. A drinking receptacle for holding and dispensing a liquid beverage, which comprises, in combination:

(a) a container means comprising a surrounding sidewall extending along and around a longitudinal axis of the container means for a bottom wall to form an open end of the container means, wherein a first sealing member is provided at the open end;

(b) a cover means mountable on the container means and having a second sealing member that mates with the first sealing member to close the open end of the container means in a sealing engagement, wherein the cover means is comprised of a sidewall closed by a top wall having an arcuate shaped drinking slot provided through the top wall and meeting with the sidewall of the cover means for removing the beverage from the drinking receptacle when the cover means is sealed on the container means and a vent opening wherein the vent opening and the drinking slot are positioned diametrically opposite each other on the top wall of the cover means, wherein when the cover means is mounted on the container means, the top wall of the cover means has a downwardly sloping tilt that slopes form the vent opening to the drinking slot, and wherein an annular ring is provided on the sidewall of the cover means for preventing beverages on the top wall of the cover means from splashing out of the cover means and wherein the annular ring has a gap adjacent the drinking slot for allowing the beverage to exit through the annular ring; and (c) an insulating sheath means mounted on the sidewall of the container means and comprised of a closed cell elastomeric material, wherein the sheath means enables a person to hold the drinking receptacle in their hand when the beverage in the container means is at or near the boiling point without burning their hands.

2. The drinking receptacle of claim 1 wherein the container means has a circular cross-section along and around the longitudinal axis and wherein the sheath means extends annularly around the sidewall of the container means from the bottom wall to a position spaced below the open end of the container means.

3. The drinking receptacle of claim 1 wherein the open end of the container means is provided by an open ended flange having an outwardly extending ledge provided at the junction of the sidewall and the flange and wherein the cover means is comprised of a sidewall having a similar shape to the shape of the open ended flange and closed by the top wall with the sidewall of the cover means seated in the open ended flange to close the open end of the container means wherein the cover means has the second sealing member that is provided on the outside sidewall of the cover means to snappingly mate with the first sealing member provided on the inside sidewall of the container means to seal the cover means on the container means.

4. The drinking receptacle of claim 1 wherein the cover means and the container means are made of a plastic material.

5. The drinking receptacle of claim 3 wherein the sheath means extends from the bottom wall of the container means to an upper portion of the sheath means abutting against the ledge.

6. The drinking receptacle of claim 1 wherein the elastomeric material is a closed cell polyolefin having an outer laminated coating.

7. The drinking receptacle of claim 1 wherein the cover means is provided with a tab means at an upper end of the sidewall of the cover means for aiding in removing the cover means from the sealing fit with the container means.

8. The drinking receptacle of claim 3 wherein the sidewall of the container means has a first, frusto-conical taper extending upwardly and outwardly along and around the longitudinal axis of the container means from the bottom wall to form the open ended flange and wherein the flange has a second, frusto-conical taper extending upwardly and outwardly along the longitudinal axis and wherein the second taper of the flange is somewhat greater than the first taper of the sidewall of the container means.

9. The drinking receptacle of claim 3 wherein the upper edge of the open ended flange is planar and is perpendicular to the longitudinal axis of the container means.

10. The drinking receptacle for holding and dispensing a liquid beverage, which comprises, in combination:

(a) a container means comprising a surrounding sidewall extending along and around a longitudinal axis of the container means from a bottom wall to form an open end of the container means wherein the open end of the container is provided by an open ended flange having an outwardly extending ledge provided at the junction of the sidewall and the flange and wherein a first sealing member is provided on the inside sidewall at the open end of the container means;

(b) a cover means mountable on the container means and having a second sealing member that mates with the first sealing member to close the open end of the container means in a sealing engagement, wherein the cover means is comprised of a sidewall having a similar shape to the shape of the open ended flange and closed by a top wall wherein the sidewall of the cover means is seated in the open ended flange and wherein the top wall is provided with a drinking slot for removing the beverage from the drinking receptacle when the cover means is sealed on the container means; and (c) an insulating sheath means comprised of a sheet of a closed cell polyolefin material having an upper edge and a lower edge between opposed ends wit the opposed ends secured together to form the sheath means, wherein the sheath means is mounted on the sidewall of the container means with the upper edge abutting against the ledge of the container means and the lower edge coplanar with the bottom wall of the container means and wherenin the sheath means enables a person to hold the drinking receptacle in their hands when the beverage in the container means is at or near the boiling point without burning their hands.

11. The drinking receptacle of claim 10 wherein the top wall of the cover means is further provided with a vent opening and the vent opening and the drinking slot are positioned diametrically opposite each other on the top wall of the cover means.

12. The drinking receptacle of claim 11 wherein when the cover means is mounted on the container means, the top wall of the cover means has a downwardly sloping tilt that slopes from the vent opening to the drinking slot.

13. The drinking receptacle of claim 10 wherein the drinking slot is an arcuate shaped opening that is provided through the top wall and meets with the sidewall of the cover means.

14. The drinking receptacle of claim 10 wherein the cover means is provided with an annular ring on the sidewall of the cover means for preventing beverages on the top wall of the cover means from splashing out of the cover means and wherein the annular ring has a gap adjacent the drinking slot for allowing the beverage to exit through the annular ring.

15. The drinking receptacle of claim 10 wherein the container means has a circular cross-section along and around the longitudinal axis.

16. The drinking receptacle of claim 10 wherein the cover means and the container means are made of a plastic material

17. The drinking receptacle of claim 10 wherein the top wall of the cover means is further provided with a vent opening and the vent opening and the drinking slot are positioned diametrically opposite each other on the top wall of the cover means and wherein when the cover means is mounted on the container means, the top wall of the cover means has a downwardly sloping tilt that slopes form the vent opening to the drinking slot and wherein the drinking slot is an arcuate shaped opening that is provided through the top wall and meets with the sidewall of the cover means.

18. The drinking receptacle of claim 10 wherein the sidewall of the container means has a first, frusto-conical taper extending upwardly and outwardly along and around the longitudinal axis of the container means from the bottom wall to form the open ended flange and wherein the flange has a second, frusto-conical taper extending upwardly and outwardly along the longitudinal axis and wherein the second taper of the flange is somewhat greater than the first taper of the sidewall of the container means.

19. The drinking receptacle of claim 10 wherein an upper edge of the open ended flange is planar and is perpendicular to the longitudinal axis of the container means.

20. The drinking receptacle of claim 10 wherein the cover means is provided with a tab means at an upper end of the sidewall of the cover means for aiding in removing the cover means from the sealing fit with the container means.

21. A drinking receptacle for holding and dispensing a liquid beverage, which comprises, in combination:

(a) a container means comprising a surrounding sidewall extending along and around a longitudinal axis of the container means from a bottom wall to form an open end of the container means wherein the open end of the container is provided by an open ended flange having an outwardly extending ledge provided at the junction of the sidewall and the flange and wherein a first sealing member is provided on the inside sidewall at the open end of the container means;

(b) a cover means mountable on the container means and having a second sealing member that mates with the first sealing member to close the open end of the container means in a sealing engagement, wherein the cover means is comprised of a sidewall having a similar shape to the shape of the open ended flange and closed by a top wall wherein the sidewall of the cover means is seated in the open ended flange and wherein the top wall is provided with a drinking slot for removing the beverage from the drinking receptacle when the cover means is sealed on the container means; and (c) an insulating sheath means comprised of a sheet of a closed cell elastomeric material having an upper edge and a lower edge between opposed ends with the opposed ends secured together to form the sheath means, wherein the sheath means is mounted on the sidewall of the container means with the upper edge abutting against the ledge of the container means and the lower edge coplanar with the bottom wall of the container means and wherein the sheath means enables a person to hold the drinking receptacle in their hands when the beverage in the container means is at or near the boiling point without burning their hands.

22. The drinking receptacle of claim 21 wherein the container means has a circular cross-section along and around the longitudinal axis.

23. The drinking receptacle of claim 21 wherein the top wall of the cover means is further provided with a vent opening and the vent opening and the drinking slot are positioned diametrically opposite each other on the top wall of the cover means.

24. The drinking receptacle of claim 23 wherein when the cover means is mounted on the container means, the top wall of the cover means has a downwardly sloping tilt that slopes from the vent opening to the drinking slot.

25. The drinking receptacle of claim 21 wherein the drinking slot is an arcuate shaped opening that is provided through the top wall and meets with the sidewall of the cover means.

26. The drinking receptacle of claim 21 wherein the cover means and the container means are made of a plastic material.

27. The drinking receptacle of claim 21 wherein the top wall of the cover means is further provided with a vent opening and the vent opening and the drinking slot are positioned diametrically opposite each other on the top wall of the cover means and wherein when the cover means is mounted on the container means, the top wall of the cover means has a downwardly sloping tilt that slopes form the vent opening to the drinking slot and wherein the drinking slot is an arcuate shaped opening that is provided through the top wall and meets with the sidewall of the cover means.

28. The drinking receptacle of claim 21 wherein the sidewall of the container means has a first, frusto-conical taper extending upwardly and outwardly along and around the longitudinal axis of the container means from the bottom wall to form the open ended flange and wherein the flange has a second, frusto-conical taper extending upwardly and outwardly along the longitudinal axis and wherein the second taper of the flange is somewhat greater than the first taper of the sidewall of the container means.

29. The drinking receptacle of claim 21 wherein an upper edge of the open ended flange is planar and is perpendicular to the longitudinal axis of the container means.

30. The drinking receptacle of claim 21 wherein the cover means is provided with a tab means at an upper end of the sidewall of the cover means for aiding in removing the cover means from the sealing fit with the container means.

31. The drinking receptacle of claim 21 wherein the cover means is provided with an annular ring on the sidewall of the cover means for preventing beverages on the top wall of the cover means from splashing out of the cover means and wherein the annular ring has a gap adjacent the drinking slot for allowing the beverage to exit through the annular ring.

* * * * *

UNITED STATES PATENT AND TRADEMARK OFFICE

CERTIFICATE OF CORRECTION

PATENT NO. : 5,253,780

DATED : October 19, 1993

INVENTOR(S) : John G. Adado

It is certified that error appears in the above-identified patent and that said Letters Patent is hereby corrected as shown below:

Column 2, line 57, "Neroard" should be --Nergard--.

Column 5, line 64 (Claim 1), "for" should be --from--.

Column 6, line 15 (Claim 1), "form" should be --from--.

Column 7, line 7 (Claim 9), "the" (second occurrence) should be --an--.

Column 7, line 11 (Claim 10), "The" should be --A--.

Column 7, line 37 (Claim 10), "wit" should be ---with--.

Column 7, line 44 (Claim 10), "wherenin" should be --wherein--.

Column 8, line 14 (Claim 17), 'form" should be --from--.

Column 10, line 1 (Claim 27), "form" should be --from--.

Signed and Sealed this

Seventeenth Day of May, 1994

Bruce Lehman

*Attest:*

BRUCE LEHMAN

*Attesting Officer*

*Commissioner of Patents and Trademarks*